US007775141B2

(12) United States Patent
Thompson et al.

(10) Patent No.: US 7,775,141 B2
(45) Date of Patent: Aug. 17, 2010

(54) EXTENDED LOW-TORQUE RATCHET WRENCH

(75) Inventors: Christopher D. Thompson, Franklin, WI (US); Daniel M. Eggert, Kenosha, WI (US); Marco E. DeVecchis, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 12/221,346

(22) Filed: Aug. 1, 2008

(65) Prior Publication Data

US 2010/0024607 A1 Feb. 4, 2010

(51) Int. Cl.
*B25B 13/46* (2006.01)

(52) U.S. Cl. ..... 81/63.1; 81/180.1

(58) Field of Classification Search ..... 81/63.1, 81/177.2, 180.1, 60, 62
See application file for complete search history.

(56) References Cited

U.S. PATENT DOCUMENTS

| | | | | | |
|---|---|---|---|---|---|
| 1,421,792 | A | * | 7/1922 | Linden | 81/60 |
| 2,565,961 | A | * | 8/1951 | Godfrey | 192/43 |
| 2,803,980 | A | | 8/1957 | Vogel | |
| 2,891,434 | A | * | 6/1959 | Lozensky | 81/60 |
| 3,127,799 | A | * | 4/1964 | Bergquist | 81/62 |
| 3,554,251 | A | | 1/1971 | McLogan | |
| 3,575,069 | A | | 4/1971 | White | |
| 3,598,001 | A | | 8/1971 | Thomasian | |
| 3,654,975 | A | | 4/1972 | Ballsmith et al. | |
| 3,802,518 | A | | 4/1974 | Albert | |
| 3,859,869 | A | | 1/1975 | Pasbrig | |
| 3,908,487 | A | | 9/1975 | Plaw | |
| 4,086,831 | A | | 5/1978 | Smith | |
| 4,128,152 | A | | 12/1978 | Tschursch | |
| 4,259,883 | A | | 4/1981 | Carlson | |
| 4,520,804 | A | | 6/1985 | DiGeorge | |
| 4,529,071 | A | | 7/1985 | Gagnon et al. | |
| 4,541,310 | A | | 9/1985 | Lindenberger | |
| 4,748,874 | A | * | 6/1988 | Sharp et al. | 81/58.1 |
| 4,901,607 | A | | 2/1990 | Beugelsdyk et al. | |
| 5,005,448 | A | | 4/1991 | Main | |
| 5,152,196 | A | | 10/1992 | Garrett | |
| 5,174,176 | A | * | 12/1992 | Krivec | 81/63.1 |
| 5,438,894 | A | * | 8/1995 | Pearce | 81/177.2 |
| 5,467,672 | A | | 11/1995 | Ashby | |
| 5,501,124 | A | | 3/1996 | Ashby | |
| 5,568,757 | A | * | 10/1996 | Lewis | 81/177.2 |
| 5,687,623 | A | * | 11/1997 | Hsieh | 81/60 |
| D397,598 | S | * | 9/1998 | Falk | D8/29 |
| 5,943,924 | A | * | 8/1999 | Jarvis | 81/177.2 |
| 5,974,915 | A | | 11/1999 | Chou | |

(Continued)

FOREIGN PATENT DOCUMENTS

| | | |
|---|---|---|
| DE | 29906562 | 4/1999 |

(Continued)

*Primary Examiner*—David B Thomas
(74) *Attorney, Agent, or Firm*—Seyfarth Shaw LLP

(57) ABSTRACT

A reversible ratchet device is provided as a low-torque application wrench in the form of an elongated body carrying a ratchet mechanism thereon, the ratchet mechanism being operable under low-torque conditions such as are present with initial driving or final loosening of a workpiece. The device includes the ratchet mechanism carried directly on the body, both being co-axially rotatable with each other and with the workpiece.

20 Claims, 6 Drawing Sheets

U.S. PATENT DOCUMENTS

| | | | | |
|---|---|---|---|---|
| D425,385 | S * | 5/2000 | Jarvis | D8/29 |
| 6,079,298 | A * | 6/2000 | Gasperi et al. | 81/63.1 |
| 6,138,531 | A * | 10/2000 | Lamons | 81/60 |
| 6,209,422 | B1 | 4/2001 | Kamiya et al. | |
| 6,263,766 | B1 * | 7/2001 | Jarvis | 81/60 |
| 6,382,059 | B1 | 5/2002 | Francis | |
| 6,389,931 | B1 * | 5/2002 | Delaney et al. | 81/60 |
| 6,397,705 | B1 * | 6/2002 | Hsieh | 81/63.1 |
| D470,369 | S * | 2/2003 | Byram et al. | D8/25 |
| 6,644,147 | B1 * | 11/2003 | Huang | 81/62 |
| 6,739,222 | B2 * | 5/2004 | Hsieh | 81/60 |
| 6,880,432 | B2 * | 4/2005 | Hsieh | 81/62 |
| 6,951,154 | B2 * | 10/2005 | Hsien | 81/60 |
| 6,976,408 | B2 * | 12/2005 | Chen | 81/60 |
| 7,017,452 | B1 * | 3/2006 | Lin | 81/60 |
| 7,066,056 | B1 * | 6/2006 | Hsieh | 81/63.2 |
| 7,191,687 | B1 * | 3/2007 | Wadsley | 81/124.3 |
| 7,380,481 | B2 * | 6/2008 | Barnett et al. | 81/63 |
| 7,389,862 | B2 * | 6/2008 | Chen et al. | 192/43 |
| 2004/0159192 | A1 | 8/2004 | Ping | |

FOREIGN PATENT DOCUMENTS

| | | |
|---|---|---|
| JP | 35-5298 | 3/1960 |
| JP | 37-29399 | 10/1962 |
| JP | 39-12090 | 5/1964 |
| JP | 40-16550 | 6/1965 |
| JP | 45-25078 | 8/1970 |
| JP | 48-66192 | 8/1973 |
| JP | 50-7297 | 1/1975 |
| JP | 51-4000 | 2/1976 |
| JP | 51-68095 | 5/1976 |
| JP | 52-14320 | 3/1977 |
| JP | 53-22699 | 3/1978 |
| JP | 61-56874 | 3/1986 |
| JP | 63-83275 | 6/1988 |
| JP | 6-71064 | 10/1994 |
| JP | 6-71065 | 10/1994 |
| JP | 3029816 | 7/1996 |
| JP | 8-216037 | 8/1996 |
| JP | 9-207075 | 8/1997 |
| JP | 9-225847 | 9/1997 |
| JP | 9-314474 | 12/1997 |
| JP | 11-165271 | 6/1999 |
| JP | 2000-382295 | 2/2000 |
| JP | 2000-117648 | 4/2000 |

* cited by examiner

EXTENDED LOW-TORQUE RATCHET WRENCH

FIELD OF THE INVENTION

The invention relates to ratchet wrenches and, in particular, to an elongated, extension wrench having a low-torque ratchet mechanism carried thereon.

BACKGROUND

Currently, a known issue for driving bolts or securing nuts is access to a periphery of the nut or the head of the bolt. As a mere example, the engine compartment of a passenger automobile and each of the components therein are designed and laid-out to maximize the use of the space within the engine compartment. The result of such engineering is that access to workpieces securing the various components either to the car or to the other components is limited. Accordingly, it has long been known to use an extension to reach the workpieces.

A common extension is generally elongated and rod-like. During use, a distal end of the extension is mated with an apparatus known as a socket driver, while a proximal end of the extension is mated with a ratchet wrench. Generally speaking, the socket driver may be mated with the ratchet wrench, yet such an arrangement would render the socket driver unable to reach the desired workpiece. Hence, the extension distal end has structure like that of the ratchet wrench so that the distal end may mate with the socket driver in order to reach the workpiece. Likewise, the proximal end includes structure like that of the socket driver so that the proximal end is mateable with the ratchet wrench for providing torque to the workpiece.

As a ratchet wrench, rotation thereof in a first direction operatively is capable of providing drive torque, while counter-rotation in a second direction opposite the first merely allows the ratchet mechanism to ratchet over a component, commonly a spring-biased pawl or pawls. In many forms, it is known for the ratchet wrench to be selectively engageable to select a drive direction and a ratchet direction. Typically this is achieved by providing a lever or similar mechanism on the ratchet wrench, reversal of the lever serving to reverse the drive and ratchet directions by adjusting a position of the pawl or pawls.

The above-described extension, used with or without the ratchet wrench, nonetheless has drawbacks. For initial driving of a workpiece, or for final removal of the workpiece, it is typical for the workpiece to rotate with very little torque applied. As a specific common example, a nut will often spin freely on a threaded bolt shank until the nut comes in contact with something else, at which time increasing amounts of torque are required to tighten the nut on the bolt. The extension may be necessary for driving or removing the workpiece, even when the workpiece is able to move with small amounts of torque, due to the location of the workpiece.

In using the extension with workpieces that require small torque amounts for at least some amount of rotations or turn, the extension is simply rotated by fingers applied directly to the extension. For the ratchet wrench, some amount of resistance must be offered by the workpiece in order for the ratchet wrench to ratchet; the workpiece that is able to rotate with small torque amounts in one desired direction usually will rotate in the opposite direction with similarly small torque amounts. Therefore, the resistance required for the ratchet wrench to ratchet is not present; alternating movements of rotation and counter-rotation by the ratchet wrench simply serve to rotate the workpiece back and forth.

Accordingly, a user typically needs to maintain at least one hand on the extension at all times to maintain contact with the workpiece. The user then also needs to turn and release the extension with their other hand. So, in one form, a user grasps the extension connected with the workpiece with a first hand and then rotates the extension to some degree. Continuing, the user then grasps the extension with the other hand while releasing the first hand, which is repositioned for a subsequent rotation. The second hand is released as the first hand begins the subsequent rotation, and so on and so forth until the workpiece is either removed or reaches the point of requiring a higher torque. In a variation of this, a user may attempt to use the ratchet wrench with the extension by using one hand to rotate and counter-rotate the ratchet wrench while the other hand applies sufficient frictional resistance to the extension so that the rotation of the ratchet wrench in the drive direction is permitted with drive torque transmitted through the extension to the workpiece, while counter-rotation of the extension along with the ratchet wrench is resisted or prevented by the user's hand, thus providing the torque sufficient for the ratchet wrench to successfully ratchet.

Accordingly, there has been a need for an improved extension and, a need for ratchet wrenches for low resistance-torque applications.

SUMMARY

In accordance with an aspect, an extension device for providing torque to a workpiece is disclosed, the extension including an elongated body having a first end proximate a user during operation for receiving torque and having a second end distal a user during operation for transmitting the torque, and a ratchet mechanism disposed around the body and located on the first end, the ratchet mechanism having a grip portion for manual manipulation, the ratchet mechanism transmitting torque to the body for when the grip portion is rotated in a drive direction, and the ratchet mechanism allowing the grip portion to slip relative to the body when rotated in a ratchet direction opposite the drive direction.

In some forms, the extension device rotates around an axis, and the workpiece and grip portion rotate around the same axis.

In some forms, the elongated body is a unitary and integral component.

In some forms, the second end includes structure for engaging and securing with a socket driver for transmitting torque to the workpiece.

In some forms, the ratcheting mechanism is a low-torque ratchet mechanism. The second end may include structure for engaging with and securing with a secondary wrench for high-torque application.

In some forms, the ratchet mechanism includes a reversing lever for selecting drive and ratchet directions, the grip portion is formed on a first component of the ratchet mechanism, and the reversing lever is a second component of the ratchet mechanism.

In some forms, the ratchet mechanism includes a pawl assembly including at least a ratchet gear carried on and secured with the body, at least one pawl, and a bias member for biasing the pawl into engagement with the ratchet gear.

In some forms, the ratchet gear and body may have non-circular cooperating engagement structure to prevent relative rotation therebetween. The cooperating engagement structure may include a flat or a lobe.

In some forms, the pawl assembly may include a pair of pawls, and the reversing lever is rotatable around the axis of the body, rotation of the reversing lever shifting one of the pawls out of engagement with the ratchet gear and permitting one of the pawls to shift into engagement with the ratchet mechanism.

In some forms, the reversing lever is in abutment with the first component and rotatably carried on the body.

In some forms, the reversing lever is rotatably carried on the first component. The reversing lever may include a ring, and the first component may include a ring, the lever ring being disposed around the first component ring.

In some forms, extension device further includes positioning structure on the reversing lever and the first component for providing defined positions therebetween. The reversing lever may include a ring, the first component may include a ring, the lever ring being disposed around the first component ring, and the positioning structure may be formed on the rings.

In some forms, the first component includes a cavity for receiving the pawl assembly. The reversing lever may encloses the cavity. The ratcheting mechanism may further include a cover plate enclosing the cavity.

In some forms, the extension device further includes a retainer for securing the ratcheting mechanism on the body. The body may include a channel, and the body and ratcheting mechanism may include cooperating engagement structure for mounting the ratcheting mechanism thereon, the retainer being a C-shaped clip securable in the channel and against the body cooperating engagement structure for securing the ratcheting mechanism on the body. The the cooperating engagement structure may include a flat or a lobe. The cooperating engagement structure may be non-circular.

BRIEF DESCRIPTION OF THE DRAWINGS

In the Figures.

DETAILED DESCRIPTION

Figure 1:
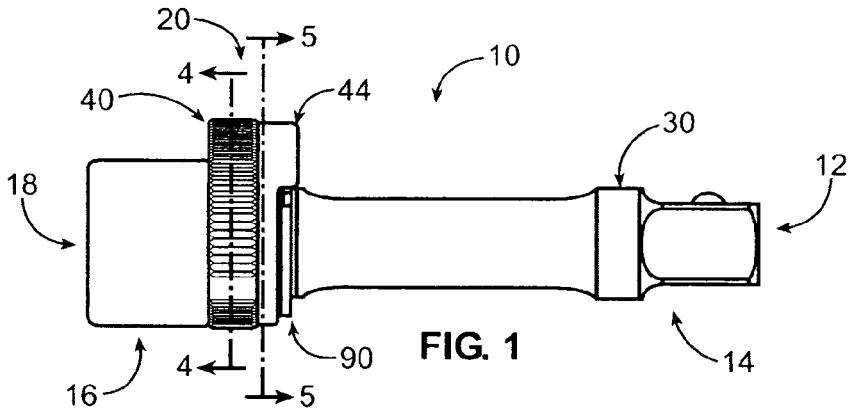
FIG. 1 is a side elevation view of a first form of a low-torque application extension of the present invention including an on-board and integrated ratchet drive mechanism.
Figure 2:
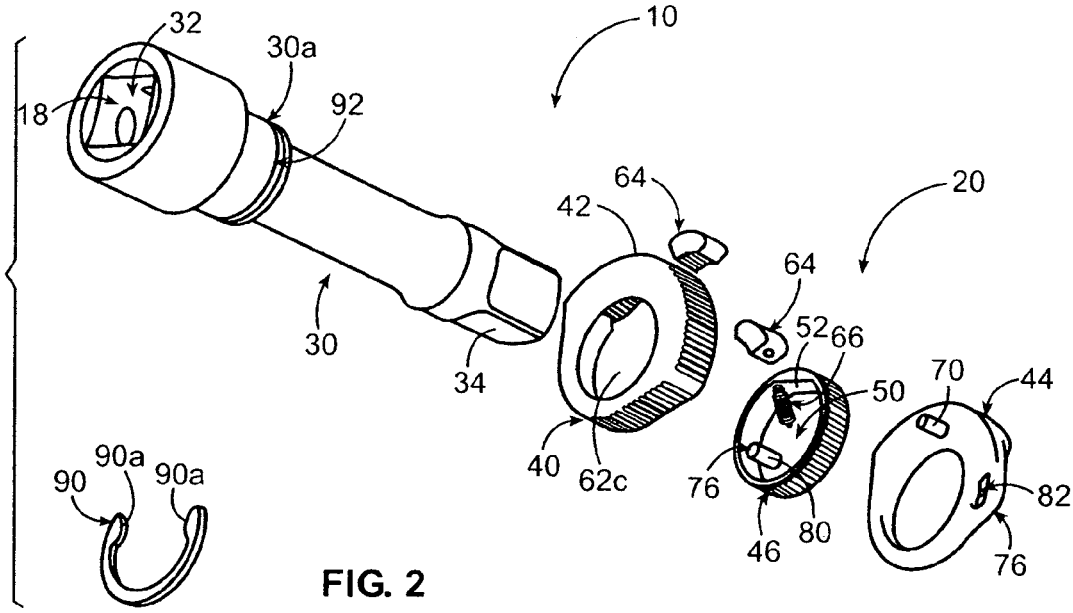
FIG. 2 is a exploded perspective view of the extension of FIG. 1.

Referring to the FIGS. 1-5, a first form of a reversible, low-profile, low-torque application ratchet extension 10 of the present invention is illustrated. As described, the extension 10 permits a user to access a workpiece that would otherwise be difficult to access, in the manner known for a conventional extension. Additionally, the extension 10 includes a distal end 12 having structure 14 for releasably engaging with a socket driver (not shown), and includes a proximal end 16 having structure 18 for releasably engaging with a ratchet wrench (not shown). As will be described in greater detail below, the extension 10 further includes a reversible ratchet mechanism 20 allowing the user to select a drive direction and accompanying ratchet direction, the ratchet mechanism 20 being constructed for low torque applications. Thus, the extension 10 is operable with standard socket drivers for engaging and rotating workpieces in a drive direction, including when the workpieces have limited access and/or when the workpieces provide little resistance to support the ratcheting of the ratchet wrench.

The extension 10 includes a body 30 similar in construction to a conventional extension. More precisely, the body 30 is generally elongate and has a circular cross-section of varying diameter. The proximal end structure 18 includes a socket opening 32 for receiving a post of a ratchet wrench (not shown). As the extension 10 includes the ratchet mechanism 20, use of the extension in a ratcheting manner does not require the ratchet wrench. The distal end structure 14 is generally a post 34 that permits connection with a socket driver (not shown), the socket driver engaging with a workpiece for applying torque thereto. As the socket driver is otherwise operable with a ratchet wrench as well, the socket driver includes a socket opening operatively identical in construction as the socket opening 32 for receiving the post 34.

The extension 10 is modified or altered with respect to a conventional extension by carrying and by being operable via the ratchet mechanism 20. In brief terms, the ratchet mechanism 20 includes a ratchet housing 40 with an outer surface 42 grippable by a user for use of the extension in a ratchet-drive manner, and the ratchet mechanism 20 includes a reversing lever 44 for selection of a drive direction for the extension 10. Therefore, upon selection of a drive direction, a user gripping the housing 40 and rotating the housing 40 in one direction provides drive torque through the extension 10 as a whole and to a workpiece. Rotation of the housing 40 in the opposite direction allows the ratchet mechanism 20 to skip or ratchet so that the extension body 30 does not rotate, and no torque is provided to the workpiece.

Note, it is recognized that, generally speaking, the extension 10 is considered to provide torque to the socket driver connected with the distal end structure 14, and the socket driver transmits the torque to a workpiece. For simplicity's sake and in recognizing that the extension 10 distal end structure 14 may be constructed to engage directly with a workpiece, discussion of providing torque from the extension 10 to a workpiece is in intended to refer to such without distinguishing whether an intermediate structure is present.

Figure 3:
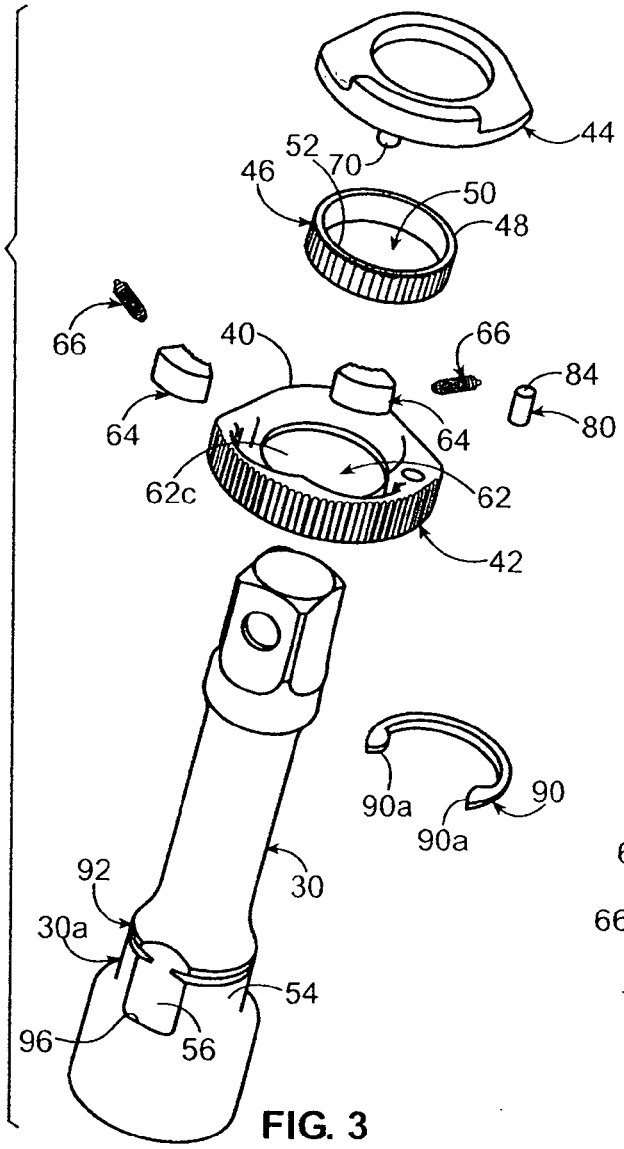
FIG. 3 is a second exploded perspective view of the extension of FIG. 1.

As can best be seen in FIG. 3, a ratchet gear 46 is provided in the ratchet mechanism 20. The ratchet gear 46 includes a generally circular and toothed outer periphery 48 along its radial surface. The ratchet gear 46 is ring-like having a central opening 50 for receiving the body 30 therein. The opening 50 is generally circular so that the ratchet gear 46 is largely annular in a proper sense, except that a flat 52 extends inwardly.

The ratchet gear 46 is received over a portion of the body 30 having a corresponding structure. That is, the body 30 has a portion 30*a* having a generally circular or cylindrical outer surface 54 with a flat 56 corresponding to the ratchet gear flat 52. The ratchet gear 46 is positioned and closely received on the extension 10 with the respective flats 52 and 56 mating so that rotation of the extension 10 rotates the ratchet gear 46 and vice versa.

Figure 4:
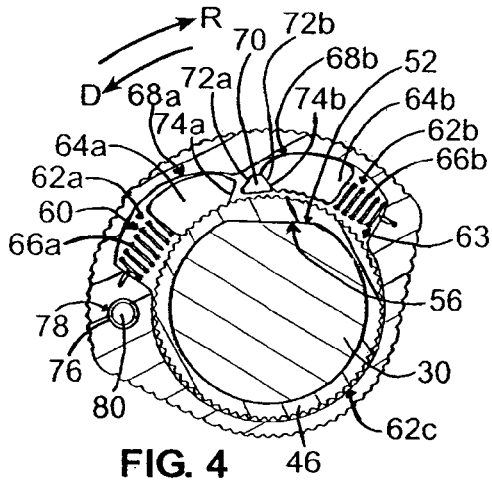
FIG. 4 is a cross-sectional view of the extension taken through the line 4-4 of FIG. 1.
Figure 5:
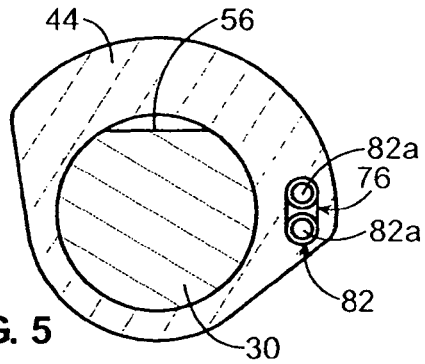
FIG. 5 is a second cross-sectional view of the extension taken through the line 5-5 of FIG. 1.
Figure 6:
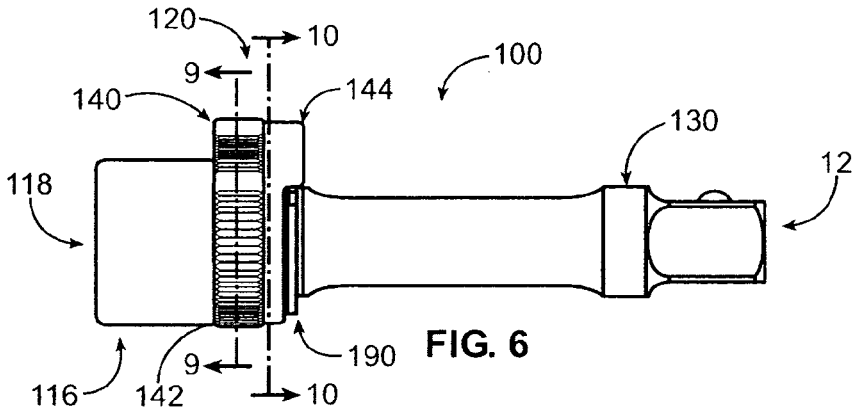
FIG. 6 is a side elevation view of a second form of a low-torque application extension of the present invention including an on-board and integrated ratchet drive mechanism.
Figure 7:
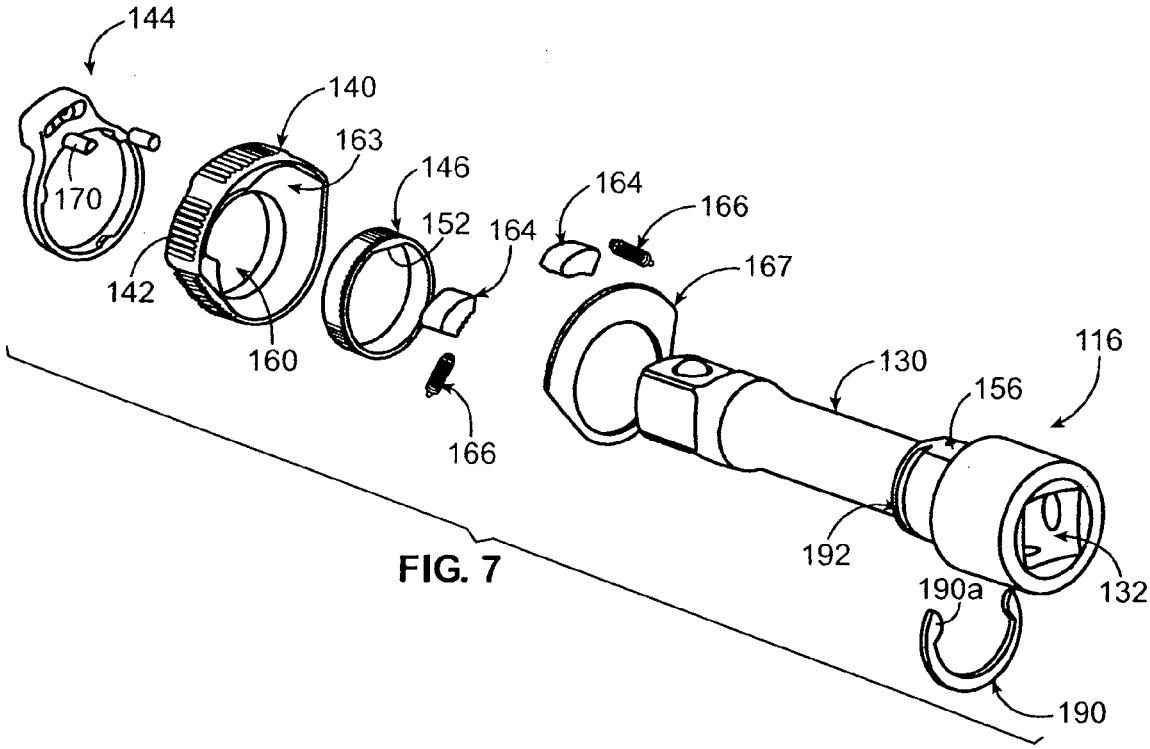
FIG. 7 is an exploded perspective view of the extension of FIG. 6.
Figure 8:
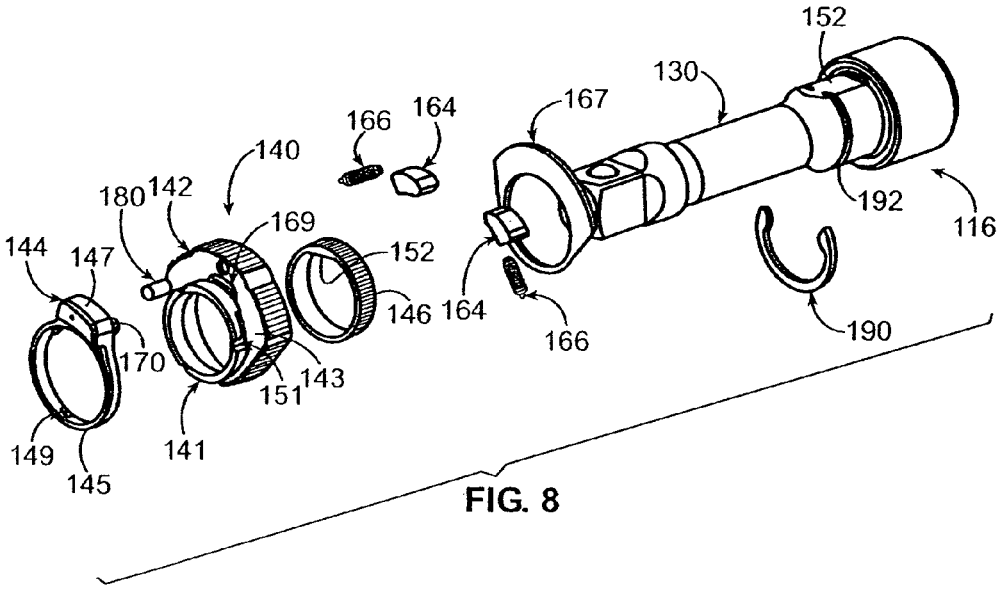
FIG. 8 is a second exploded perspective view of the extension of FIG. 6.
Figure 9:
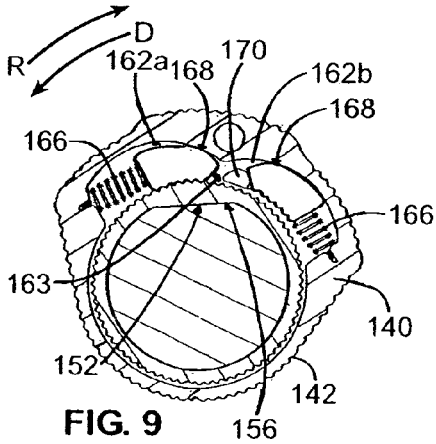
FIG. 9 is a cross-sectional view of the extension taken through the line 9-9 of FIG. 6.

The housing 40 is positioned around the ratchet gear 46 and includes a reversible pawl assembly 60 for selecting drive and ratchet directions via engagement with the ratchet gear 46. Turning to FIG. 4, the housing 40 includes an opening 62 having three distinct portions: first and second portions 62*a* and 62*b* are formed as pawl pockets for receiving first and second pawls 64*a* and 64*b*, while a third portion 62*c* is generally circular and is positioned closely around the teeth of the ratchet gear 46.

In FIG. 4, the first pawl 64*a* is engaged with the ratchet gear 46 and, thus, a drive direction D and ratchet direction R are selected, as shown by the arrows labeled as such. The first pawl 64*a* is biased by a resiliently compressible member in the form of a first coil spring 66*a* into engagement with the ratchet gear 46 or, viewed another way, into engagement with an inwardly sloping wall 68*a* formed on the first pawl pocket 62*a*, which in turn directs the first pawl 64*a* into engagement with the ratchet gear 46. Thus, when the housing 40 is rotated in the drive direction D, the first pawl 64*a* is pressed between the sloping wall 68*a* and the ratchet gear 46 to lock the housing 40 with the ratchet gear 46. When the housing 40 is rotated in the opposite direction, the ratchet direction R, only the spring 66*a* provides any force to maintain the first pawl 64*a* in engagement with the ratchet gear 46: to the degree rotation of the ratchet gear 46 and extension in the ratchet direction R provide torque resistance, the teeth of the ratchet gear 46 cause the first pawl 64*a* to compress the first spring 66*a* and, in a sense, the teeth of the ratchet gear 46 act to cam the first pawl 64*a* out of engagement. The first pawl 64*a* will shift a sufficient amount until the respective teeth thereof are able to slip, or ratchet, over the teeth of the ratchet gear 46.

While the ratcheting ability is understood by one skilled in the art, it is simply noted that such depends on the relative use of springs 66 with a low spring constant (a "light" spring), and teeth for both the pawls 64 and the ratchet gear 46 that are small relative to the diameter of the ratchet gear 46.

As can be seen, the second pawl 64*b* is held out of engagement with the ratchet gear 46 by a post 70. Were the reversing lever shifted 44, the drive direction D and the ratchet direction R would be reversed, the second pawl 64*b* would be shifted into engagement like is shown in FIG. 4 for the first pawl 64*a*, and the first pawl 64*a* would be shifted out of engagement like is shown in FIG. 4 for the second pawl 64*b*.

The post 70 is carried on the reversing lever 44. In the present configuration, the post 70 is shown as somewhat trapezoidal in order to have a first ramp 72*a* for contacting a first chamfer 74*a* formed on the first pawl 64*a*, and a second ramp 72*b* for contacting a second chamfer 74*b* formed on the second pawl 64*b*. As the reversing lever 44 is rotated, discussed below, the post 70 is shifted relative to the housing 40 and the pawl assembly 60 so that the first ramp 72*a* either contacts or moves away from the first chamfer 74*a*, while the second ramp 72*b* does the opposite with respect to the second chamfer 74*b*. In this manner, the reversing lever 44 serves to force a pawl 64 (such as second pawl 64*b*) out of engagement so that the other pawl 64 (first pawl 64*a*) is forced into engagement with the ratchet gear 46 by its spring 66 (i.e., first spring 66*a*).

A detent mechanism 76 is provided for generally maintaining the reversing lever 44 and housing 40 in defined positions for the selected drive and ratchet directions D, R. The reversing lever 44 generally abuts the housing 40 and rotates generally co-axially therewith around the body 30. The housing 40 includes a blind recess or bore 78 for receiving a plunger 80 and spring (not shown) that biases the plunger 80 towards the reversing lever 44. The reversing lever 44, in turn, has a recess 82 for receiving a tip 84 of the plunger 80. The recess 82 is slightly arcuate to account for the small relative rotation between the reversing lever 44 and the housing 40 when the reversing lever 44 is rotationally shifted between positions to select the drive and ratchet directions D, R. The recess 82 includes two distinct positions, such as having a pair of slight cups 82*a* formed therein for receiving the plunger tip 84, and the ends of the recess 82*b* provide stops for limiting rotation of the reversing lever 44 relative to the housing 40.

A retainer 90 is provided for maintaining the ratchet mechanism 20 on the body 30. In the illustrated embodiment, the retainer 90 is generally a C-shaped snap ring, and the body 30 includes a channel 92 cut into the surface thereof proximate portion 30*a*. The snap ring 90 includes enlarged portions 90*a* which are received on the flat body 56 to prevent rotation of the snap ring 90.

It should be noted that the extension 10 provides a low profile. In a preferred form, the portion 30*a* on which the ratchet mechanism 20 including the grip surface 42 is secured is of a reduced diameter in comparison with proximal end structure 18. Thus, a shoulder 96 on the body 30 between proximal end structure 18 and the portion 30*a*, the ratchet mechanism 20 being secured between the shoulder 96 and the snap ring retainer 90. It should also be noted that the housing opening 62 passes through the housing 40 for the third, circular portion 62*c*, while the pawl pockets 62*a*, 62*b* do not pass through. The pawl pockets 62*a*, 62*b* thus somewhat define a cavity 63 in which the pawls 64 and the springs 66 are located. The reversing lever 44, in abutment with the housing 40, thus serves as a cover for the cavity.

Turning now to FIGS. 6-10, a second form of a reversible, low-profile, low-torque application ratchet extension 100 of the present invention is illustrated. As for the above-discussed extension 10, the second form of an extension 100 includes a body 130 having ends 112, 116 for connecting with a workpiece, a ratchet wrench, and/or a socket driver (not shown). A ratcheting mechanism 120 is secured with the body 130 via a retainer 190. The ratcheting mechanism 120 includes a housing 140 with a grip surface 142 and including a reversing lever 144 for selecting drive and ratchet directions D, R. The reversing lever 144 shifts pawls 164 into and out of engagement with sloping walls 168 formed on pawl pockets 162*a*, 162*b* of an opening 162 in the housing 140 positioned around a ratchet gear 142. The ratchet gear 142 is mated with the body 130 to prevent or restrict relative rotation therebetween, preferably via respective flats 152, 156 therebetween.

As the operation and many of the components of the second extension 100 are generally the same as the first extension 100, the differences shall be highlighted. As can be seen, the pawl pockets 162*a*, 162*b* are part of a cavity 163 that is oriented towards the proximal end 116, while the first extension 10 has such cavity 63 facing the distal end 12. To enclose the cavity 163, a cover plate 167 is provided. While this cover plate 167 is an additional component, it can be secured to the housing 40 to reduce the ingress of contaminants into the cavity 163 in comparison with the form of the first extension 10. It should also be noted that slot 169 (FIG. 8) is added to the housing 140 to allow the post 170 of the reversing lever 144 to pass through the housing 140 and into the cavity 163.

Additionally, the use of the cover plate 167 allows a reduction in the size of the reversing lever 144 in comparison to the reversing lever 44, amongst other features. As can best be seen in FIGS. 6, 8, and 10, the reversing lever 144 is carried directly on the housing 140. Towards this end, the housing 140 includes a ring 141 extending distally away from a body portion 143. The reversing lever 144 includes a ring 145 and a tab 147 extending radially therefrom, the reversing lever ring 145 being positioned around the housing ring 141. The tab 147 is enlarged relative to the lever ring 145, but preferably no larger in radial extent from the extension axis of rotation, so that rotation of the reversing lever 144 to select drive and ratchet directions is ergonomically easy for a user.

Figure 10:
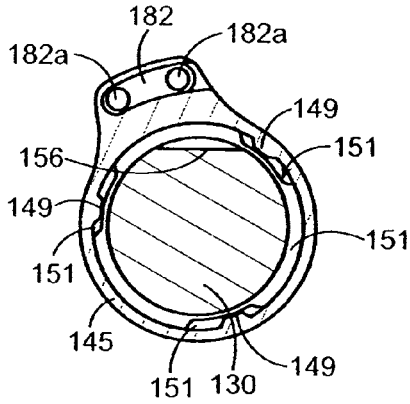
FIG. 10 is a second cross-sectional view of the extension taken through the line 10-10 of FIG. 6.
Figure 11:
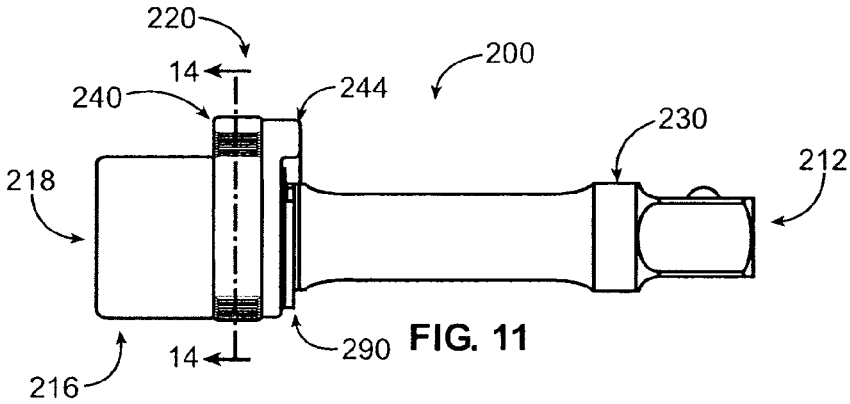
FIG. 11 is a side elevation view of a third form of a low-torque application extension of the present invention modifying the second form of FIG. 6.
Figure 12:
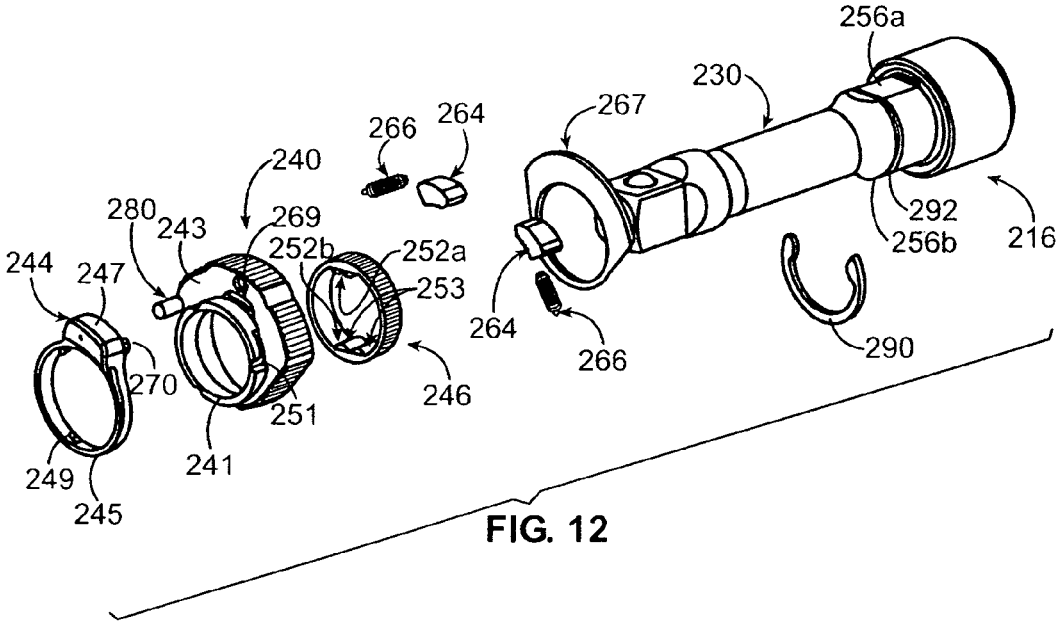
FIG. 12 is an exploded perspective view of the extension of FIG. 11.
Figure 13:
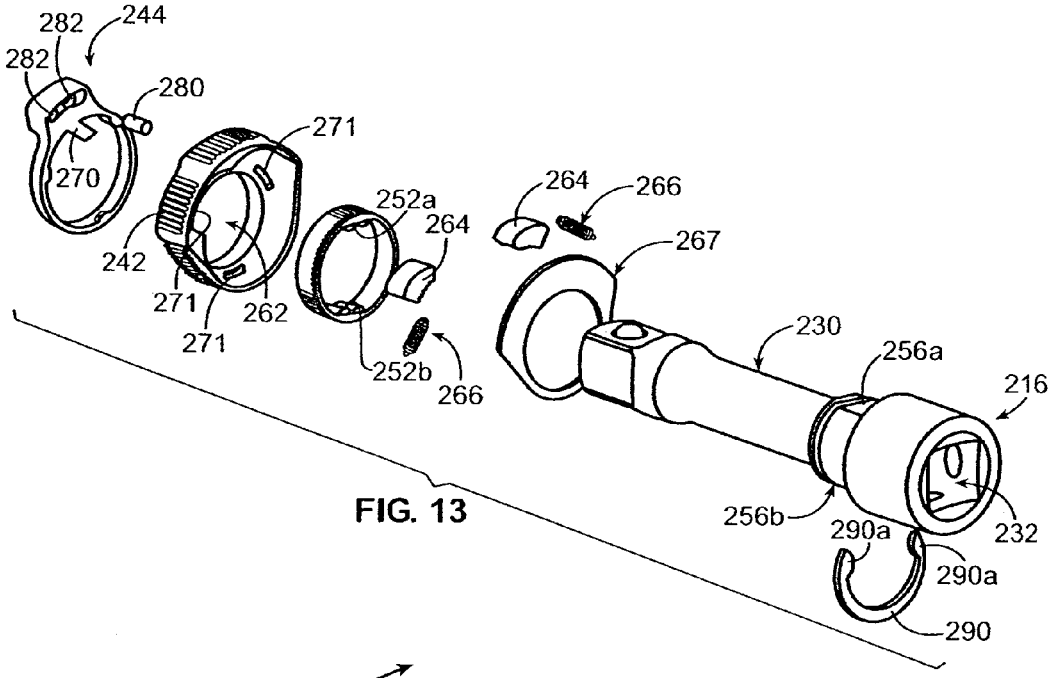
FIG. 13 is a second exploded perspective view of the extension of FIG. 11.
Figure 14:
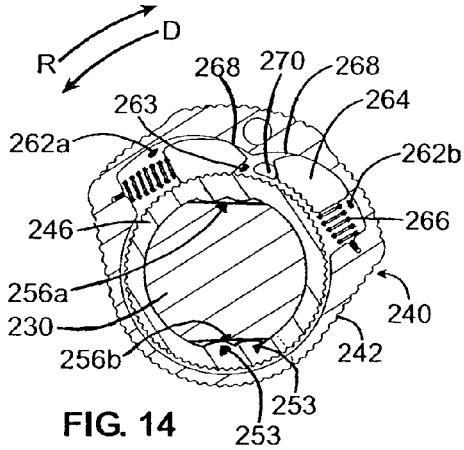
FIG. 14 is a cross-sectional view of the extension of taken through the line 14-14 of FIG. 11

In the illustrated form, the reversing lever 144 and housing 140 include a plunger 180 and a cupped recess 182, like that discussed for the first extension 10. However, additionally or in the alternative, the rings 141, 145 of the housing 140 and reversing lever 145, respectively, may also provide distinct positions and stops for relative rotation therebetween. As can be seen, the lever ring 145 includes tabs 149, while the housing ring 141 includes key ways 151 for receiving the tabs 149. With reference to FIG. 10, the cooperation between tabs 149 and key ways 151 can be seen. The tabs 149 and key ways 151 can be constructed as guides for minimizing friction between the reversing lever 144 and housing 140, as well as can be constructed with appropriate contours such that they operate to lock and/or provide stops, such as by frictionally engaging or by having a ramp to a flat, then a depression, (not shown).

A further form of a reversible, low-profile, low-torque application ratchet extension 200 of the present invention is illustrated in FIGS. 11-14. The extension 200 is similar in many respects to the extension 100 and includes a body 230 having ends 212, 216 for connecting with a workpiece, a ratchet wrench, and/or a socket driver (not shown). A ratcheting mechanism 220 is secured with the body 230 via a retainer 290. The ratcheting mechanism 220 includes a housing 240 with a grip surface 242 and includes a reversing lever 244 for selecting drive and ratchet directions D, R. The reversing lever 244 shifts pawls 264 into and out of engagement with sloping walls 268 formed on pawl pockets 262*a*, 262*b* of an opening 262 in the housing 240 positioned around a ratchet gear 242. The pawl pockets 262*a*, 262*b* are part of a cavity 263 oriented towards the proximal end 216, the cavity 263 closed by a cover plate 267, and slot 269 (FIG. 12) allows post 270 of the reversing lever 244 to pass through the housing 240 and into the cavity 263.

The housing 240 includes a ring 241 extending distally away from a body portion 243, and the reversing lever 244 includes a ring 245 and a tab 247 extending radially therefrom, the reversing lever ring 245 being positioned around the housing ring 241. The tab 247 is enlarged relative to the lever ring 245, but preferably no larger in radial extent from the extension axis of rotation, so that rotation of the reversing lever 144 to select drive and ratchet directions is ergonomically easy for a user.

The reversing lever 244 and housing 240 include a plunger 280 and a cupped recess 282. The rings 241, 245 of the housing 240 and reversing lever 245, respectively, may also provide distinct positions and stops for relative rotation therebetween. As can be seen, the lever ring 245 includes tabs 249, while the housing ring 241 includes key ways 251 for receiving the tabs 249.

Turning towards the differences between the extension 200 of FIGS. 11-14 and the extension 100 of FIGS. 6-10, it is noted that the extension 100 includes the ratchet gear 142 mated with the body 130 to prevent or restrict relative rotation therebetween. To achieve such, for the extension 100, the ratchet gear 142 and body 130 have respective flats 152, 156 therebetween. For the extension 200 of FIGS. 11-14, the body 230 and ratchet gear 242 again have cooperating or abutting structure to achieve such; however, the body 230 is provided with a pair of diametrally positioned flats 256*a*, 256*b*, while the ratchet gear 242 is provided with a pair of diametrally positioned surfaces 252*a*, 252*b* having a lobed shape and, preferably, having a pair of lobes 253 on each surface 252*a*, 252*b*.

Additionally, it is noted that the housing 240 includes cut-outs 271 passing therethrough. The cut-outs 271 are aligned with the key ways 251 and simplify manufacturing and assembly.

As described, the forms of extensions 10, 100, 200 provide an elongated extension as is conventionally known for accessing workpieces small or low clearance locations, obviate the need for a separate ratchet wrench as the ratchet mechanism is carried on the extension, and provide such ratchet mechanism in a low-torque form for low-torque applications. As described, the extensions also permit the use of a separate ratchet wrench and conventional socket drivers by having cooperating engagement structure therefor, which allows the secondary ratchet wrench to be used in the event high torque is required. The extensions 10, 100, 200 are operable by gripping a portion thereof, such as manually grasping grip portions 42, 142, 242, and rotating and counter-rotating in drive and ratchet directions D, R, the rotation being about a common axis of rotation for the extension 10, 100, 200 itself as well as a common axis for a workpiece. To permit and facilitate ease of use, the ratchet mechanism is carried near the proximal end, during use, of the extension, as is a reversing lever for selecting and changing the drive and ratchet directions.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An extension device for providing torque to a workpiece, the extension comprising:

an elongated unitary and integral body having a first end proximate a user during operation for receiving torque, the first end including a socket for connection with a ratchet wrench, and a second end distal a user during operation for transmitting the torque; and a ratchet mechanism including a toothed ratchet gear and at least one ratchet pawl engageable with the ratchet gear, the ratchet mechanism disposed around the body and located on the first end, the ratchet mechanism having a grip portion for manual manipulation and for receiving torque, the ratchet mechanism transmitting torque to the body for when the grip portion is rotated in a drive direction, and the ratchet mechanism allowing the grip portion to slip relative to the body when rotated in a ratchet direction opposite the drive direction, wherein the ratchet mechanism includes a reversing lever for selecting drive and ratchet directions, the grip portion is formed on a first component of the ratchet mechanism, and the reversing lever is a second component of the ratchet mechanism.

2. The extension device of claim 1 wherein the extension device rotates around an axis, and the workpiece and grip portion rotate around the same axis.

3. The extension device of claim 1 wherein the second end includes structure for engaging and securing with a socket driver for transmitting torque to the workpiece.

4. The extension device of claim 1 wherein a first ratio is defined between the size of the corresponding ratchet gear teeth and ratchet pawl teeth and a diameter size ratchet gear, the ratchet mechanism further including at least a spring for biasing each ratchet pawl into engagement with the ratchet gear, the first ratio and the spring defining an extension torque level at which the ratchet mechanism is able to slip relative to the body, said extension torque level being below a torque level torque of said ratchet wrench, such that the ratcheting mechanism is a low-torque ratchet mechanism.

5. The extension device of claim 4 wherein the second end includes structure for engaging with and securing with a secondary wrench for high-torque application.

6. The extension device of claim 1 wherein the ratchet gear is carried on and secured with the body, further including a bias member for biasing the pawl into engagement with the ratchet gear.

7. The extension device of claim 6 wherein the ratchet gear and body have non-circular cooperating engagement structure to prevent relative rotation therebetween.

8. The extension device of claim 7 wherein the cooperating engagement structure includes a flat or a lobe.

9. The extension device of claim 6 wherein the at least one pawl includes a pair of pawls, and the reversing lever is rotatable around the axis of the body, rotation of the reversing lever shifting one of the pawls out of engagement with the ratchet gear and permitting one of the pawls to shift into engagement with the ratchet mechanism.

10. The extension device of claim 1 wherein the reversing lever is in abutment with the first component and rotatably carried on the body.

11. The extension device of claim 1 wherein the reversing lever is rotatably carried on the first component.

12. The extension device of claim 11 wherein the reversing lever includes a ring, and the first component includes a ring, the lever ring being disposed around the first component ring.

13. The extension device of claim 1 further including positioning structure on the reversing lever and the first component for providing defined positions therebetween.

14. The extension device of claim 13 wherein the reversing lever includes a ring, and the first component includes a ring, the lever ring being disposed around the first component ring, and the positioning structure being formed on the rings.

15. The extension device of claim 1 wherein the first component includes a cavity for receiving the at least one pawl.

16. The extension device of claim 15 wherein the reversing lever encloses the cavity.

17. The extension device of claim 15 wherein the ratcheting mechanism further includes a cover plate enclosing the cavity.

18. An extension device for providing torque to a workpiece, the extension comprising:

an elongated unitary and integral body having a first end proximate a user during operation for receiving torque, the first end including a socket for connection with a ratchet wrench, and a second end distal a user during operation for transmitting the torque; and a ratchet mechanism including a toothed ratchet gear and at least one ratchet pawl engageable with the ratchet gear, the ratchet mechanism disposed around the body and located on the first end, the ratchet mechanism having a grip portion for manual manipulation and for receiving torque, the ratchet mechanism transmitting torque to the body for when the grip portion is rotated in a drive direction, and the ratchet mechanism allowing the grip portion to slip relative to the body when rotated in a ratchet direction opposite the drive direction, the extension device further including a retainer for securing the ratcheting mechanism on the body, wherein the body includes a channel, and the body and ratcheting mechanism include cooperating engagement structure for mounting the ratcheting mechanism thereon, the retainer being a C-shaped clip securable in the channel and against the body cooperating engagement structure for securing the ratcheting mechanism on the body.

19. The extension device of claim 18 wherein the cooperating engagement structure includes a flat or a lobe.

20. The extension device of claim 18 wherein the cooperating engagement structure is non-circular.

* * * * *